United States Patent [19]

Takashima

[11] 4,025,047

[45] May 24, 1977

[54] MOULDING FOR THE HEAT RETENTION OF FEEDER HEAD IN CASTING MOLTEN METALS

[75] Inventor: Masaru Takashima, Komae, Japan

[73] Assignee: Aikoh Co., Ltd., Tokyo, Japan

[22] Filed: June 27, 1975

[21] Appl. No.: 590,800

Related U.S. Application Data

[62] Division of Ser. No. 460,048, April 11, 1974, Pat. No. 3,975,200.

[52] U.S. Cl. ..... 249/204; 164/53; 249/106

[51] Int. Cl.² ..... B22D 7/10

[58] Field of Search ..... 249/204, 197, 198, 199, 249/200, 201, 202, 106; 106/38.2, 38.22, 38.27, 38.28, 38.5, 38.9; 164/94, 43, 47, 53

[56] References Cited

UNITED STATES PATENTS

| | | | |
|---|---|---|---|
| 1,051,787 | 1/1913 | Vollmer | 249/106 |
| 1,278,206 | 9/1918 | Potter | 249/106 X |
| 1,989,096 | 1/1935 | Jones | 249/204 X |
| 2,165,945 | 7/1939 | Seaver | 164/94 X |
| 2,272,018 | 2/1942 | Nicholas | 249/197 |
| 2,282,248 | 5/1942 | Rowe | 249/106 X |
| 2,462,256 | 2/1949 | Charman | 249/204 X |
| 3,423,496 | 1/1969 | Olstowski | 106/38.5 X |
| 3,804,642 | 4/1974 | Rumbold | 106/38.27 X |
| 3,848,655 | 11/1974 | Sato | 249/197 X |
| 3,923,526 | 12/1975 | Takashima | 106/38.28 X |

FOREIGN PATENTS OR APPLICATIONS

| | | | |
|---|---|---|---|
| 868,639 | 5/1961 | United Kingdom | 164/53 |

*Primary Examiner*—Francis S. Husar
*Assistant Examiner*—J. S. Brown
*Attorney, Agent, or Firm*—Fay & Sharpe

[57] ABSTRACT

A moulding for the heat retention of feeder head top surface in casting molten metals is based on a mixture consisting of charcoal and a binder, and said charcoal is laminated with directional properties in the laterial direction. If circumstances require, the moulding may contain at least one component selected from the group consisting of thermo-expansible materials, organic binders and organic fibrous materials, and further when occasion demands it may be coated with a shell containing fibrous materials and a binder.

6 Claims, 6 Drawing Figures

MOULDING FOR THE HEAT RETENTION OF FEEDER HEAD IN CASTING MOLTEN METALS

Figure 1:
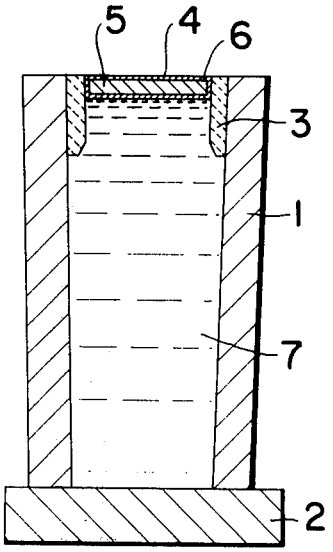

This is a division of application Ser. No. 460,048, filed Apr. 11, 1974, and now U.S. Pat. No. 3,975,200.

This invention relates to an improvement of a moulding for the heat retention of feeder head in casting molten metals, and more particularly, molten iron and steel.

For the purpose of avoiding the occurrence of piping to the major body of the casting when casting molten metals, and more especially, molten steel and iron, it is important, in order to delay the solidification of molten metal in the feeder head than that of the major body, that the heat loss from the molten metal in said feeder head is avoided and that said molten metal in the feeder head is retained for sufficiently a long time in a molten state to be able to feed it to the piping. The process in which the solidification of molten metal in the feeder head is delayed than the solidification of said major body, i.e. the process of obtaining the so-called heat-retaining effect in feeder head, is to promote the function of delaying the solidification of said feeder head by heating the side and top surfaces of the feeder head by means of exothermic or heat-insulating materials or by heat-insulating and retaining the heat holdings. Conventionally, exothermic or heat-insulating powders or mouldings by exothermic materials, refractories, etc. which create the thermit reaction are properly used by the size of mold, the kind of molten metal, etc. It is no doubt desired for the heat-retaining agents or mouldings that they are highly exothermic and moreover of excellent heat insulation. However, it is required for present exothermic materials to make their density high to increase the calorific value per unit volume, due to which fact thermal conductivity is raised and heat insulation is lowered so that heat retention is defective. In order to raise heat insulation the exothermic materials need be provided with light weight and porosity, and it has been impossible with conventional materials in order to give sufficient exothermic property to the light weight and porous materials. There is not any kind of material which has, in a single kind of material, both sufficient exothermic and heat-insulating properties. To satisfy these properties there must be two layers of exothermic layer and heat-insulating layer and it results in the addition of many great troubles for moulding.

The present invention is to provide a moulding with a heat-retaining material which serves for both exothermic and heat-insulating properties. That is, roughly crushed charcoal is used as principal material. When produced, charcoal has large radial voids from the centre of material wood, is skeleton-like and further has innumerable small pores. Charcoal can be roughly crushed piece-like. If the particle size is in such an extent as passing a sieve of 10 mm. square, the whole charcoal become small pieces and lose its archetype such as many-sided, odd and other shapes. When scattered, the charcoal pieces are piled up approximately in layer state, produce a great number of fine pores, and in cooperation with the fine pores of their own the heat insulation becomes extremely great and the thermal conductivity becomes low such as 0.05 Kcal/m. hr. °C. Since charcoal itself contains carbon approximately by 100 percent it has a high calorific value of approximately 8,000 Kcal/kg, and when the charcoal pieces are scattered to the molten metal surface they immediately burn in the molten metal contact portion to heat the molten metal surface. Burning takes place in the surface because of the heat-insulating property of charcoal and does not easily transfer into the internal portion so that there are essential characteristics in charcoal in that the rise of thermal conductivity by temperature rise does not take place. Charcoal as it is crushed will be flown in dust state when it burns on the molten metal surface, so that in the present invention the charcoal is moulded and used as a moulding. If charcoal only is used the moulding is thickened by the burnt share, and therefore to mould the charcoal as a moulding the charcoal is mixed with vermiculite or expansible graphite as a expansible material. Both the vermiculite and thermo-expansible graphite expand in case the moulding burns and prevent the volume of the moulding from natural decrease, but both the materials become flaky when expanding and even if they enter between the spaces of charcoal pieces and expand big voids scarcely take place. In the present invention it has been found that with an approximately definite mixing proportion between the charcoal and the thermo-expansible material, the best suitable heat retention is made for the moulding. The mixing proportion between the charcoal and the vermiculite or the graphite which has been given an expansibility by acid treatment varies according to the particle size of charcoal, but in the case of below 10 mm. sieve used in the present invention, and when the particle size is more than 2 mm, the proportion by weight has been 1:0.07–0.20. If charcoal is of coarse mesh the bulk specific gravity of the moulding decrease so that the quantity of said thermo-expansible material may be small. However, in case the thermo-expansible material is below 0.07 the volume loss of the burnt charcoal cannot be recovered, and in the case of an addition of the material by more than 0.20 to the contrary the expansion is too large and the pores emit heat so that heat retention is lost. In case the particle size of charcoal is below 2 mm. the bulk specific gravity becomes comparatively great, so that the thermo-expansible material is furnished in a larger amount that in the previous case, and the proportion by weight between the charcoal and the thermo-expansible material is made 1:0.10–0.40. Since ignition and burning are quick if the charcoal particle size is smaller, there will be a great burning loss and it is just as mentioned above to recover the volume loss. In this case, however, if the thermo-expansible material is less than 0.10 it is not sufficient to recover the volume loss, and if it is more than 0.40 there occur an expansion and too great pores so as to damage the heat retention. The above thermo-expansible materials, being between the layers of the piece-like charcoal, expand flaky and are charged between the charcoal pieces, never making large pores, so that only the two material are suitable and other material such as obsidian, perlite and shale are unsuitable. In preparing moulding, organic fibrous materials of 3–15 are added to bridge and compact the spaces between the particles of the mixing materials. This is to prevent the moulding from damage after moulding and before use, and they also serve as a function they are burnt away when contacted with fire in use. As the organic fibrous material there are employed beated waste paper, pulp, cotton fibre, etc. If the organic fibrous materials are less than 3 percent the bridging action is limited and the moulding becomes fragile. If they are more than 15 percent the fibrous property becomes excessive, there will exist extra fibrous property other than bridging action, and the sense of addition is lost. Further, as a binder to form the moulding an organic binder of 3–15 percent is employed. This is to fix the moulding, ignite immediately when burnt in use and burn the charcoal. Resin, starch, dextrin, glue, etc. are suitable as the binder. If the bulk specific gravity is large when moulding the binder is used in less amount, but if it is small to the contrary the binder is employed in larger amount. However, in the case of below 3 percent of the binder, the moulding may be likely to break, and if it is more than 15 percent it will close the pores of said moulding to lose heat-retaining effect.

Furthermore, one of the essential features of this invention comprises a moulding in which the inner layer whose major constituent is charcoal is coated with a shell consisting of a mixture of the fibrous materials and the binder.

One of the inventions for the moulding which is coated with shell concerns a composition in which the inner layer making the main body contains more than 30 percent by weight of charcoal, and a composition wherein more than 20 percent by weight of said charcoal is laminated like alluvium which has directional properties in the direction of the heat-retaining moulding, i.e. in the laterial direction, and wherein the shell contains fibrous materials and binder; that is, it relates to a moulding for feeder head top surface characterised in that said fibrous materials are entangled. According to the present invention, a sufficient heat-retaining effect for feeder head is yielded by the inner layer based on charcoal having good heat-retaining properties, and at the same time the strength of said moulding to high temperature increases by the shell of the composition of said fibrous materials, so that there takes place no cracking by the heat of the molten metal. Moreover, since mechanical strength also increases the moulding is hardly damaged in transit or handling.

According to another invention for moulding which is coated with shell, a moulding wherein the inner layer contains less than 30 percent by weight of a thermo-expansible material further promotes the heat-retaining effect of the feeder head, and therefore it is preferable as the moulding for feeder head top surface of the present invention. Said moulding expands according to the expansion of the thermo-exansible material by the heat of the molten metal, but since the expansion occurs wholly from the interior of said moulding any cracking does not take place.

Still another invention for moulding which is coated with shell relates to a composition wherein the inner layer making the main body containing at its central portion more than 30 percent by weight of charcoal, a composition wherein not less than 20 percent by weight of the charcoal is laminated like alluvium having directional properties in the lateral direction of the moulding, and the periphery of said inner layer contains not less than 30 percent by weight of charcoal and not more than 30 percent by weight of the thermo-expansible material, and a composition wherein more than 20 percent by weight of said charcoal is laminated like alluvium having directional properties in the lateral direction of the moulding and said shell contains fibrous materials and a binder; that is, it is concerned with a moulding for feeder head top surface characterised in that said fibrous materials are entangled.

In the mouldings which have been coated with the shell, the reason why the charcoal content is more than 30 percent by weight is that with less than 30 percent content the excellent heat-insulating properties and burning of the charcoal cannot sufficiently be utilised for the heat retention for said feeder head. By laminating more than 20 percent by weight of the charcoal in the inner layer like alluvium by giving directional properties in the lateral direction of said mouldings, a great number of pores preferable for heat retention are produced in the inner layer so that the heat-retaining effect for the feeder head as the whole inner layer is advanced. Further, since the burning of the charcoal is controlled the excellent heat-insulating properties can be utilised for a long time. It is also possible to increase the strength of the mouldings. The reason that the quantity of the charcoal laminated like alluvium having directional properties in the lateral direction of said moulding is not less than 20 percent by weight of the charcoal in the inner layer, is that if it is below 20 percent the porosity in the inner layer is not preferable for heat retention, and the moulding strength is lowered. Said alluvium-like lamination can be prepared in such manner that a composition containing charcoal is added with liquid such as water to make the composition slurry- or paste-like, and that the slurry or paste is dehydrated with a moulding model having net for dehydration.

The term structure "laminated like alluvium" referred to in the present invention specification means a structure in which in the case of using the present composition as slurry-like, the small pieces of the charcoal in said slurry are set in the direction parallel to the maximum surface of said moulding, to be formed.

As the thermo-expansible materials used in the mouldings which have been coated with shell there can be mentioned natural ores such as vermiculite, shales, obsidians, perlites, pitch stone and bloating clay or graphite pieces and pitch chemically treated with acids and/or oxidising agents. The reason that the content of said thermo-expansible materials in the inner layer is not more than 30 percent by weight is that with more than 30 percent content the moulding expands too much, and therefore, the pores of the moulding become too large by expansion to be through-holes and the heat-retaining effect for feeder head is lowered.

Said inner layer may be a composition containing, besides charcoal and the thermo-expansible materials, known components employed as conventional heat-retaining materials for feeder head.

The shell of the moulding for use in the heat retention of said feeder head top surface according to this invention is a composition containing a binder wherein fibrous materials are entangled, and in the shell there may be contained refractory materials such as siliceous sand, aluminium oxide, magnesium oxide, etc. Preferably, the shell is a composition of fibrous materials such as beated waste paper, wood chips, cotton, asbestos, slag wool, rock wool, glass wool and chemical fibres and a binder such as phenol, resin, urea resin, dextrin or starch. Said shell will be suitably produced in such manner that said fibrous materials and said binder are added with liquid such as water to make slurry and that the slurry is dehydrated with a moulding model having net for dehydration, to form said composition of the fibrous materials and the binder. The shell thus produced has well-entangled fibrous materials, the materials being coupled strongly with one another by the binder, and an extremely great strength.

Further, according to another embodiment of the shell, it may be of paper wherein formation is made by sticking cardboard (in the case of thin paper, a number of sheet) by a binder to the periphery of the inner layer pre-formed in board state.

In the first and second inventions, i.e. the production of the mouldings which are not coated with shell, organic fibrous materials are suspended in water, and with stirring thereof other mixing agents are added thereinto to prepare a slurry of 60 percent water content. Said slurry is poured into a mold, the water content is removed by sucking, compressing, centrifugal separation and other processes, and finally the slurry is heat-dried in a drying machine.

Examples of the mouldings in accordance with the invention will now be described:

EXAMPLE 1

Mixing ratio (%) of moulding:

| | No. 1 | No. 2 | No. 3 | No. 4 | No. 5 | No. 6 |
|---|---|---|---|---|---|---|
| Charcoal 10mm–2mm | 75 | 77 | — | — | 72 | — |
| Charcoal < 2mm | — | — | 59 | 75 | — | 71 |
| Vermiculite | 15 | — | 23 | — | 4 | 2 |
| Graphite treated with acid | — | 5 | — | 8 | 4 | 3 |
| Pulp | 5 | 3 | 15 | 5 | 8 | 12 |
| Starch | — | 10 | 3 | 4 | 2 | 8 |
| Thermosetting resin | 5 | 5 | — | 8 | 10 | 4 |

There have been formed various thicknesses of mouldings of the above mixing ratio. 40 mm. Thickness of the moulding has been used for steel ingots of less than 6 t., 60 mm. thickness for those of from 6 to 10 t., 70 mm. thickness for those of from 10–15 t. and 80 mm. thickness for those of more than 15 t., respectively. The head portions of the steel ingots showed quite a plane shrinkage condition and inconvenient piping, segregation and so on have not taken place at all.

Figure 2:
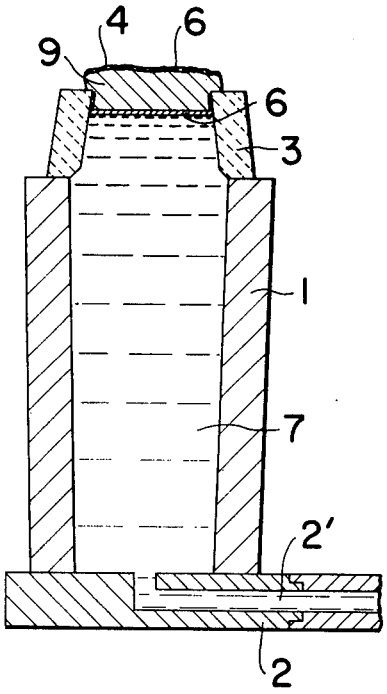
Figure 3:
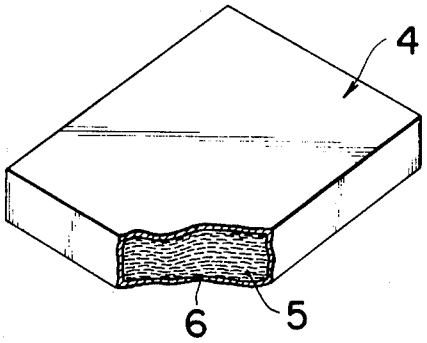
Figure 4:
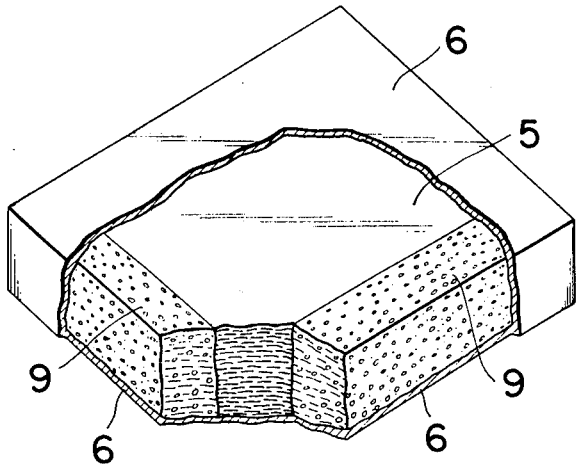
Figure 5:
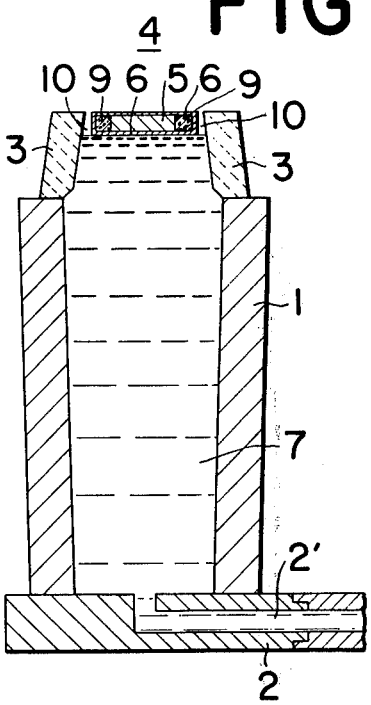
Figure 6:
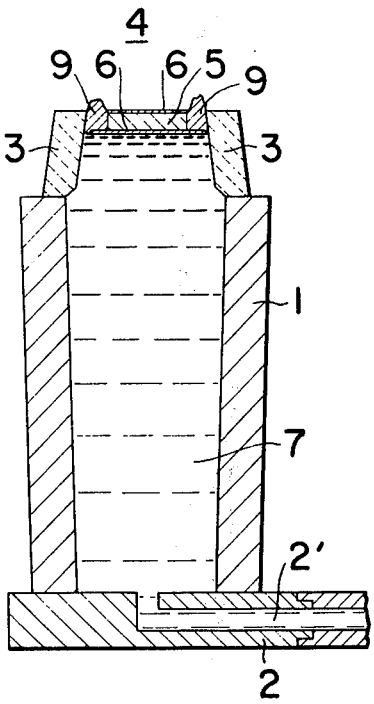

Furthermore, an embodiment of said mouldings coated with shell will be explained to concrete with reference to the accompanying drawing, wherein FIGS. 1 and 2 are vertical sectional views of an embodiment in which a shell-coated moulding 4 of the present invention is used for ingot moulding, FIG. 3 is a perspective view of a moulding 4 consisting of an inner layer containing not less than 30 percent by weight of charcoal and a shell, FIG. 4 is a perspective view of a moulding, a part of which has been cut away and in which the central portion of the inner layer consists mainly of charcoal, the periphery thereof consists of a mixture of charcoal with expansible materials, and said inner layer is coated with shell, the reference numerals showing the same materials as in FIGS. 1 to 3, FIG. 5 is a vertical sectional view of an embodiment of the moulding in FIG. 4 and the molten steel surface wherein said moulding has just been added to said surface, and shows conditions under which spaces 10 forcedly take place between a moulding 4 and a moulding 3 for the heat retention of side surface, because of the different sizes and shapes of the two mouldings, and FIG. 6 is the same view as in FIG. 5 but showing the conditions under which peripheral portions 9 of the moulding 4 have finished to expand more than in the conditions of FIG. 5, and the spaces between the moulding 4 and the moulding 3 for the heat retention of side surface have been filled, preventing the molten steel heat from escaping from said spaces. In this case, such a moulding 4 is suitable for use in a kind of steel which can be completely heat-retained even without expanding the neighbourhood of the central portion of said moulding and for which shrinkage comparatively does not appear.

FIG. 1 is a vertical sectional view showing the use of the moulding 4 for heat-retaining the feeder head according to the present invention, and shows the conditions under which a molten steel 7 is poured, according to the top pouring system, into a mold 1 at the inner surface of the upper portion of which is provided a moulding 3 for the heat retention of feeder head side surface, and the molten steel surface of said feeder head is heat-retained being covered with a moulding 4. Said moulding 4 consists of an inner layer 5 which is a composition containing not less than 30 percent by weight of charcoal and a shell 6 which is a composition containing a binder wherein fibrous materials have been entangled. Reference numeral 2 in the drawings shows a stool.

FIG. 2 is a vertical sectional view showing the use of the moulding 4 of this invention, which contains thermo-expansible materials, and the conditions under which a molten steel 7 is poured, in accordance with the bottom pouring system, from a runner 8 in the stool 2 into the mold 1 on the upper end of which has been placed a moulding 3 for heat-retaining the feeder head side surface, and the molten steel surface of said feeder head is being covered and heat-retained with the moulding 4 which has been expanded by the heat of the molten steel. Said moulding 4 comprises an inner layer 9 of the composition charcoal and thermo-expansible materials and a shell 6 containing a binder wherein fibrous materials are entangled; and the moulding has expanded according to an expansion of the thermo-expansible materials by the heat of the molten steel.

FIG. 3 is a perspective view showing the conditions under which a part of the moulding 4 of the invention has been cut away. This moulding is a composition containing not less than 30 percent by weight of charcoal, and consists of an inner layer 5 in which charcoal pieces have been laminated like alluvium by being given directional properties in their lateral direction, and a shell 6 containing a binder wherein fibrous materials have entangled with one another.

FIG. 4 shows a moulding in which a central portion 5 of the inner layer chiefly consists of charcoal and the peripheral part 9 thereof consists of a mixture of charcoal and expansible materials, and the inner layer is coated with a shell. The reference numerals in the drawing show the same materials as in the previous embodiments.

Examples of the mouldings coated with shell in accordance with the invention will be stated below in detail.

EXAMPLE 2

1. Mixing ratio of the constituents of the inner layer:

| | | |
|---|---|---|
| Charcoal | 85% | by weight |
| Powdered cokes | 12% | " |

-continued

| | | |
|---|---|---|
| Phenol resin | 3% | " |

2. Mixing ratio of the constituents of the shell:

| | | |
|---|---|---|
| Beated waste paper | 60% | by weight |
| Asbestos | 20% | " |
| Slag wool | 10% | " |
| Phenol resin | 10% | " |

Water has been added to the mixture (1) above to make the mixture paste-like. Water has also been added to the mixture (2) above to prepare a slurry in which the solid content of the constituents of said mixture (2) is approximately 20 percent and the water content approximately 80 percent. Said slurry (2) in the amount in which solid content may become 3 mm. thick when dehydrated, has been filled into a moulding model having net for dehydration. Further, into the slurry there has been charged said paste-like material (1) in the amount which may become approximately 34 mm. thick when dehydrated, and the mixtures has been dehydrated in vacuum state. Upon the dehydrated material there has been charged said slurry (2) of the amount which may become approximately 3 mm. thick when dehydrated, and the mixture has been dehydrated again. The dehydrated moulded article has been dried to produce such a moulding for the heat retention of feeder head (the length of which is 830 mm., width 830 mm. and thickness 40 mm.) as shown in FIG. 4. It has been found that in said moulding the charcoal pieces in the inner layer are laminated in lateral direction, and the fibrous materials in the shell are entangled and cohered strongly with phenol resin.

With the use of this moulding twenty 8-ton steel ingots have been cast by the top pouring system as shown in FIG. 1. These steel ingots have been compared with those which have been cast with the use of conventional, same sized moulding for the heat retention of feeder head but under the same conditions as in the present invention in other respects. As a result, it has been found that the steel ingots which used the moulding of the present invention have advanced by 1.3 percent in mean yield of steel ingot, compared with the ingots for which conventional mouldings have been employed. This evidently shows that the moulding of this invention is superior over conventional mouldings in the heat-retaining of feeder head.

In addition, the moulding according to the invention has a great strength so that it has never been damaged in transit or handling. To the contrary it is known that the damage percentage of conventional articles is about 2 percent.

EXAMPLE 3

1. Mixing ratio of the constituents of the inner layer:

| | | |
|---|---|---|
| Charcoal | 60% | by weight |
| Vermiculite | 20% | " |
| Powdered coal | 17% | " |
| Dextrin | 3% | " |

2. Mixing ratio of the constituents of the shell:

| | | |
|---|---|---|
| Paper pulp | 50% | by weight |
| Wood chips | 20% | " |
| Slag wood | 20% | " |
| Phenol resin | 8% | " |
| Starch | 2% | " |

In the same way as in Example 1 there has been produced a moulding for the heat retention of feeder head (the length of which is 780 mm., the width 780 mm. and the thickness 35 mm., and the thickness of the shell being 3 mm.) as shown in FIG. 3.

With the use of this moulding twenty 7-ton steel ingots have been cast by means of the bottom pouring system as shown in FIG. 3. It has been found that these steel ingots are advanced by 1.5 percent in the mean yield of steel ingot, compared with the steel ingots cast with the use of conventional mouldings for the heat retention of feeder head. Damage in transit or handing of this moulding has never been noticed.

EXAMPLE 4

The composition slurry (2) in Example 1 has been filled in a moulding model according to the same instrument and process, into said slurry has been entered the composition paste (1) in Example 2 in the amount which may become 34 mm. after dehydration, and the composition paste (1) in Example 3 has been filled to the peripheral portion of said model, to be sucked and dehydrated. After said composition slurry (2) has been poured and added on the dehydrated material, mold releasing and drying have been carried out to prepare a moulding for heat-retaining the feeder head in the size in which the length is 800 mm., the width 800 mm. and the thickness 35 mm. With the use of said moulding there have been cast twenty 7.3-ton steel ingots in accordance with the bottom pouring system. In comparing these ingots with those cast by employing conventional mouldings for the heat retention of feeder head, the mean yield of steel ingot has promoted by 1.3 percent.

What I claim is:

1. A moulded slab for the retention of heat in an ingot mould comprising an inner layer having an elongated surface and an outer shell encapsulating said inner layer, said inner layer containing not less than 30 percent by weight of charcoal particles with not less than 20 percent by weight of said charcoal particles being laminated in a direction parallel to the elongated surface of the inner layer, and said shell comprised of fibrous materials and a binder therefor.

2. The moulded slab of claim 1 wherein said inner layer also contains from trace amounts to not more than 30 percent by weight of a thermo-expansible material.

3. The moulded slab of claim 2 wherein said thermo-expansible material is selected from the group consisting of vermiculite, shales, obsidians, perlites, pitch stone, bloating clay, graphite, oxidized pitch and mixtures thereof.

4. The moulded slab of claim 1 wherein said outer shell also contains a refractory material selected from the group consisting of siliceous sand, aluminum oxide, magnesium oxide and mixtures thereof.

5. The moulded slab of claim 1 wherein the fibrous materials in said shell are selected from the group consisting of beaten waste paper, wood chips, cotton asbestos, slag wool, rock wool, glass wool, chemical fibers and mixtures thereof.

6. A generally flat moulded slab for the retention of heat in an ingot mould comprising a generally rectangular, elongated inner layer having a thickness less than its length; a peripheral layer enclosing the thickness of said inner layer; and an outer shell encapsulatng said inner layer and said peripheral layer, said inner layer containing at least 30 percent by weight of charcoal particles with not less than 20 percent by weight of said charcoal particles being laminated in a direction parallel to the length of said elongated inner layer, and said peripheral layer containing not less than 30 percent by weight charcoal particles and from a trace amount to not more than 30 percent by weight thermo-expansible material.

* * * * *